United States Patent [19]

Suganuma et al.

[11] Patent Number: 4,491,477

[45] Date of Patent: Jan. 1, 1985

[54] ANTI-WEAR SINTERED ALLOY AND MANUFACTURING PROCESS THEREOF

[75] Inventors: Tetsuya Suganuma, Nagoya; Koji Kazuoka, Toyota; Shuichi Fujita, Toyota; Yoshitaka Takahashi, Toyota; Takeshi Okujo, Toyota, all of Japan

[73] Assignee: Toyota Jidosha Kabushiki Kaisha, Toyota, Japan

[21] Appl. No.: 411,041

[22] Filed: Aug. 24, 1982

[30] Foreign Application Priority Data

Aug. 27, 1981 [JP] Japan ..... 56-134535

[51] Int. Cl.[3] ..... B22F 3/00

[52] U.S. Cl. ..... 75/230; 75/231; 75/243; 419/30; 419/46; 419/11

[58] Field of Search ..... 419/30, 46, 11; 75/230, 75/231, 243

[56] References Cited

U.S. PATENT DOCUMENTS

| | | | |
|---|---|---|---|
| 3,863,318 | 2/1975 | Niimi et al. | 75/231 |
| 3,918,923 | 11/1975 | Inoue | 75/231 |
| 4,243,414 | 1/1981 | Takahashi et al. | 419/11 |
| 4,253,874 | 3/1981 | Cundill | 419/33 |
| 4,268,309 | 5/1981 | Serino et al. | 75/230 |
| 4,271,239 | 6/1981 | Warner | 419/11 |

FOREIGN PATENT DOCUMENTS

| | | | |
|---|---|---|---|
| 52-28407 | 3/1977 | Japan | 75/231 |

*Primary Examiner*—Brooks H. Hunt

*Attorney, Agent, or Firm*—Oblon, Fisher, Spivak, McClelland & Maier

[57] ABSTRACT

An anti-wear sintered alloy comprising from 2.5 to 25.0% of Cr, from 0.10 to 3.0% of Mn, from 0.1 to 0.8% of P, from 1.0 to 5.0% of Cu, from 0.5 to 2.0% of Si, from 0 to 3% of Mo, 1.5 to 3.5% of C, one selected from the group consisting of from 0.5 to 3.0% of S and from 1.0 to 5.0% of Pb, and the balance being Fe with less than 2% of impurities, wherein S or Pb is distributed uniformly in the sintered alloy in form of sulfide or lead particle of less than 100 μm and a manufacturing process thereof.

8 Claims, 4 Drawing Figures

ANTI-WEAR SINTERED ALLOY AND MANUFACTURING PROCESS THEREOF

BACKGROUND OF THE INVENTION

Field of the Invention

The present invention relates to an anti-wear sintered alloy having excellent slidable property. More specifically, the invention relates to an anti-wear sintered alloy having improved self-lubricating property and fitness to an opponent sliding member of the anti-sintered alloy disclosed in U.S. Pat. No. 4,268,309 and in U.S. patent application Ser. No. 213,239. The invention also relate to a process for manufacturing such an anti-wear sintered alloy.

U.S. Pat. No. 4,268,309 discloses the anti-wear sintered alloy comprising 15 to 25 wt.% of Cr, 0.3 to 0.8 wt.% of P, 1 to 5 wt.% of Cu, 0 to 3 wt.% of Mo, 1.5 to 4.0 wt.% of C and the balance being Fe with less than 2 wt.% of impurities. (Hereinafter, "%" means "wt.%") U.S. patent application Ser. No. 213,239 discloses the anti-wear sintered alloy comprising 2.5-7.5% of Cr, 0.1-3.0% of Mn, 0.2-0.8% of P, 1-5% of Cu, 0-3% of Mo, 1.5-3.5% of C and the balance being Fe with less than 2% of impurities. These references describe that such anti-sintered alloys are suitable for use as a slidable member, such as a cam shaft and rocker arm in the valve operating system, which must be placed in service under high-plane pressure conditions because the sintered alloys in these references have an excellent anti-wear property with a high density and high hardness.

Under the circumstances that the high-performance of the automobiles has been strongly demanded in recent years, however, the service conditions of the rocker arm and cam are getting severer and severer.

SUMMARY OF THE INVENTION

An object of the present invention is to provide an anti-wear sintered alloy which improves the anti-wear resistance of the sintered alloy disclosed in U.S. Pat. No. 4,268,309 and U.S. patent application Ser. No. 213,239.

More specifically, the object of the present invention is to provide an anti-wear sintered alloy having excellent slidability in which sulfur or lead having effective self-lubrication property is dispersed in form of fine particles in the alloy.

Still another object of the present invention is to provide a process for manufacturing an anti-wear sintered alloy having excellent slidability in which sulfur of lead having effective self-lubrication property is dispersed in form of fine particles in the alloy.

The anti-wear sintered alloy according to the present invention comprising 2.5-25.0% of Cr, 0.1-3.0% of Mn, 0.1-0.8% of P, 1.0-5.0% of Cu, 0.5-2.0% of Si, 0-3.0% of Mo, either 0.5-3.0% of S or 1.0-5.0% of Pb, 1.5-3.5% of C, and less than 2% of impurities, and the balance being Fe, the anti-wear alloy containing S or Pb in the form of sulfide or Pb particles having less than 100 μm in particle size uniformly dispersed in it.

The anti-wear sintered alloy according to the present invention is manufactured by preparing through atomization an alloy powder containing alloy elements in specified amounts respectively except for carbon, adding a specified amount of carbon, for instance, in a form of graphite powder to the alloy powder, compacting the mixture thus obtained into a specified profile, and then sintering it.

BRIEF DESCRIPTION OF THE DRAWING

These and other objects, features and advantages of the present invention will be appreciated upon the reading of the detailed description of the preferred embodiments of the present invention in conjunction with the attached drawing in which:

FIG. 1(*b*) is a schematic view illustrating the state of the mixed powder as shown in FIG. 1(*a*) after sintering;

FIG. 2(*b*) is a schematic view illustrating the state of the mixed powder as shown in FIG. 2(*a*) after sintering.

DETAILED DESCRIPTION OF THE PREFERRED EMBODIMENTS OF THE PRESENT INVENTION

Figure 1:
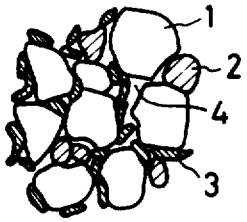
FIG. 1(*a*) is a schematic view illustrating the state of a mixed powder before sintering.
Figure 1:
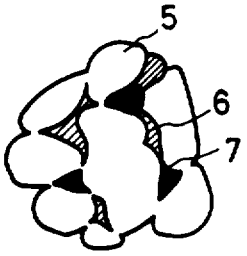
Figure 2:
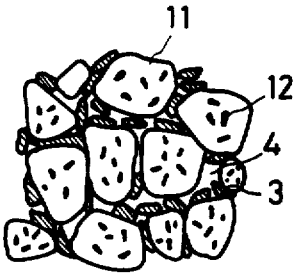
FIG. 2(*a*) is a schematic view illustrating the state of a mixed powder according to the present invention before sintering.
Figure 2:
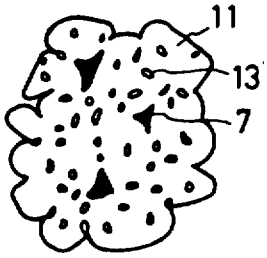

Now, the present invention will be described more in detail with reference to the drawing.

The anti-wear sintered alloy according to the present invention is characterized by high anti-wear resistance and high fitting property to an opponent member. The anti-wear sintered alloy comprises 2.5-25% of Cr; 0.10-3.0%, preferably 0.10-1.5% of Mn, 0.1-0.8%, preferably 0.35-0.65% of P; 1.0-5.0%, preferably 1.0-3.0% of Cu; 0.5-2.0%, preferably 0.7-1.5% of Si; 0-3.0%, preferably 0.5-1.5% of Mo; either 0.5-3.0%, preferably 0.5-2.0% of S or 1.0-5.0%, preferably 1.0-3.0% of Pb; 1.5-3.5%, preferably 1.8-3.0% of C; less than 2.0% of impurity; and the balance being Fe. S (or Pb) in the sintered alloy is uniformly deposited in a form of sulfide(lead) of less than 100 μm in particle size.

The sintered alloy according to the present invention can be obtained by preparing an alloy powder 11 composed of the elements containing S (or Pb) 12 except carbon; adding a specified amount of carbon 13 to this powder to make a compacted powder (green compact); and then sintering the mold.

The alloy powder, which is the material of the sintered alloy according to the present invention, is obtained by the routine process, but it is usually obtained from a molten metal by the atomizing method.

According to the atomising method the molten alloy material prepared after mixing the powders of the alloy elements together except carbon is atomized from the upper side to produce the atomized metal while the jet water stream is blown against the dropping molten metal from the side in the $N_2$ atomsphere. The particle size of the atomized alloy powder is passably less than 80 mesh, preferably less than 100 mesh and less than 350 mesh which constitutes less than 40% of the volume.

The material alloy powder should desirably contain as the impurities: oxygen less than 0.5%, preferably less than 0.3%; and carbon less than 0.3%, preferably less than 0.1%.

The atomised alloy powder thus obtained is added with carbon, usually graphite, preferably scaly graphite. Usually graphite of up to about 10μ in mean particle diameter is employed, but fine particles of less than 2-3μ would be preferable. These elements may be blended by the routine procedure but a specific matrix blending method, a depressurized blending method or a vibration-mill method can be adopted. These methods will minimize the segregation of graphite in the blending and compacting processes, thereby making the matrix hardness, the shape, size and distribution of carbides in different parts of the product uniform and giving desirable results with less variances in the anti-wear, anti-scuffing and anti-pitting properties of the product.

In blending, the conventional lubricant like zinc stearate may be added to the atomized alloy powder with carbon according to the present invention. The amount of the lubricant to be added may be less than about 1.2%, preferably about 0.3-1.0%.

The material thus prepared is compacted, sintered and then cooled. The compacting is done to a desired shape usually under a pressure of about 5—about 7 t/cm$^2$, preferably about 5.5—about 6.5 t/cm$^2$. The density of the compacted product is passably about 5.8—about 6.4 g/cm$^3$, preferably about 5.9—about 6.3 g/cm$^3$. The compacted powder is next sintered at a temperature in the range of about 1020° C.—about 1180° C., preferably about 1050° C.—about 1150° C. The sintering time depends on the temperature. The sintering is performed usually for about 30 or about 90 minutes. It is desirable that the sintering be done in a gas such as hydrogen, nitrogen, hydrogen-nitrogen mixture, or decomposed ammonia, or in vacuum; and it is undesirable that it be done in the common RX denatured gas. The dew point of the atmosphere used is desirably less than −10° C., more desirably less than −20° C.

The sintered mass thus yielded acquires the necessary hardness through a cooling to about 600° C. at a rate of about 10° C./min, preferably 20°-100° C./min.

Using the sintered alloy thus obtained, engine cam and other parts can be manufactured. For example, an engine cam of this sintered alloy may be integrated to a steel pipe by utilizing the liquid phase generated in sintering, thus producing a desired cam-shaft. In working and assembling the machine parts, it is possible to increase the strength of a presintered mass through a presintering, which is usually done in AX gas of 900°-1000° C.

The reasons for the limitation of the amounts of the elements in the sintered alloy according to the present invention are as follows:

Chrome is considered to contribute to improvement in anti-wear and anti-scuffing properties, and the content of it is limited to from 2.5 to 25.0%. If it is less than 2.5%, the anti-wear property of the sintered alloy is deteriorated, while if it exceeds 25.0%, the effect by the addition of chrome is not obtained. Inversely, the slidability characteristics change and the attacking property to a piece to be coupled is undesirably increased.

Manganese is solid-solved into the matrix to enhance the strength of the matrix, activate sintering of the iron base, suppress the growth of the crystals with result of refining and spheroidization of the carbides, thereby improving the slidability characteristics of the sintered alloy. If the addition of Mn is less than 0.10%, such effects does not appear, while it is more than 3.0%, the atomized alloy powder is spheroidized and hardened. Thereby greately deteriorating the compressibility and moldability of the alloy powder and making it impossible to obtain a desired density and hardness. Furthermore, since excess manganese leads to the increase in the residual austenite at the time of sintering, it is likely that the hardness inversely drops and the sinterability is damaged-through oxidation. Therefore, the addition of Mn is limited to from 0.10 to 3.0%, preferably from 0.10 to 1.5%.

Phosphorus is solid-solved into the matrix during sintering, not only to activate the sintering and enable the sintering at a lower temperature but also to form steadite phase with a low melting point, thereby enhancing the density through liquid phase. Such effects imparted by the addition of P is insufficient if it is less than 0.2%. If it exceeds 0.8%, the liquid phase is produced too much so that the carbide and steadite abnormally grow, thereby embrittling the crystalline boundaries and lowering the slidability characteristics. Thus, the addition of P is limited to from 0.2 to 0.8%. The optimum amount is from 0.35 to 0.65%.

Molybdenum, like Cr, strengthens the matrix to enhance hardenability and increase the hardness of the sintered alloy. Further, it serves to form the hard complex carbide mainly composed of $(Fe, Cr, Mo)_3C$, thereby improving the slidability characteristics. Even with no Mo, the characteristics necessary for a slide member such as cam can be assured. But, the addition of Mo spheroidizes the profile of the carbide and suppresses the attacking property to a piece to be coupled. Therefore, the addition of less than 3% of Mo is effective. If it is more than 3%, the network like carbides are formed at the crystalline boundaries to embrittle the sintered alloy, damage the slidability characteristics and lead to the high production cost. Thus, the addition of Mo is limited to less than 3%, preferably from 0.5 to 1.5%.

Copper, being solid-solved into the matrix, stabilizes the sintering, increases the hardness through strengthening the iron base, and make finer and speroidizes the carbides. The addition of less than 1.0% of Cu is ineffective, while the addition of more than 5.0% of Cu inversely weakens the crystalline boundaries, lowers the slidability characteristics, and increases the production cost. Thus, the addition of Cu is limited to from 1.0 to 5.0%, preferably from 1.5 to 3.0.

Silicon, being solid-solved into the matrix, stabilizes the sintering of the iron base and spheroidizes the carbide particles. Moreover, silicon is essential as deoxidizer at the time of atomizing the alloy powder. However, it is less than 0.5%, the oxidation can not be suppressed so as to produce insufficient deoxidizing effect. On the other hand, the addition of more than 2% of Si leads to the lowering of the hardenability of the matrix and the hardness of the sintered alloy, but also to the coarsening and maldistribution of the carbides at crystalline boundaries, thereby deteriorating the slidability. Thus, the addition of Si is limited to from 0.5 to 2%, preferably from 0.7 to 1.5%.

Carbon, which is usually applied as graphite, is solid-solved into the matrix to increase the hardness and strengthen the iron base; forms the complex carbide together with other metal in the alloy powder; and contributes the formation of the steadite phase, thereby enhancing the anti-wear property. However, if the addition of C is less than 1.5%, the hardness of the matrix and the amount of the steadite are unsatisfactory, while the addition of more than 3.5% of C promotes the coarsening and network growth of the matrix, carbide and steadite at the crystalline boundaries of so that the slidability characteristics are greatly impaired and the attacking property to a piece to be coupled is increased. Thus, the addition of C is limited to 1.5 to 3.5%. The optimum range is from 1.8 to 3.0%.

Sulfur or lead to be included in the alloy powder has a self-lubrication imparting effect. The addition of S is limited to from 0.5 to 3.0%, preferably from 0.5 to 2.0%. The addition of Pb is limited to from 1.0 to 5.0%, preferably from 1.0 to 3.0%. Too little addition of either of the elements exhibits insufficient self-lubrication effect, while too much addition leads to embrittlement of the sintered alloy. This is the reason for the above limitations. The embrittlement due to the addition of S is effectively suppressed by the addition of from 0.1 to 3.0% of Mn.

In the present invention, the way of adding S (or Pb) is an important factor. Conventionally, as shown in FIG. 1(*a*), sulfur powdered (or lead) in form of powdered sulfide (or lead compound) is added to and mixed with the separately prepared alloy powder (1) consisting of the other metal elements as well as graphite, followed by sintering. In this method, as shown in FIG. 1(*b*), the particles of sulfide (or lead) particles (6) are maldistributed at the crystalline boundaries of the alloy matrixes (5) including the carbides. In this figure, a reference numeral (4) is a space, (7) being a pore. Furthermore, in case the alloy and sulfide (lead compound) powders are separately prepared, the particle size of the powder containing S (or Pb) becomes larger so that such larger particles may cover the surfaces of the alloy powder, thereby making the interdiffusion between the alloy powder particles insufficient with the result of interruption of smooth sintering. Consequently, the density of the sintered alloy drops to deteriorate the characteristics of the anti-wear sintered alloy, i.e. lower hardness, lower strength, anti-wear property.

According to the present invention, the material including the alloy elements in specified amounts respectively other than carbon is atomized to produce the alloy powder; and then carbon is added thereto, followed by molding and sintering. The fine particles of sulfide (or lead) are deposited uniformly in the sintered alloy and therefore the sintered alloy having an excellent slidability characteristics can be obtained. Further, as mentioned above, since the particles of sulfide (or lead) do not interrupt the sintering, the anti-wear property inherent to the sintered alloy will not be damaged.

Compared with the method in which the sulfide powder (or the lead powder) are prepared separately from the alloy powder, and mixed with each other, followed by compacting and sintering, the sulfide (or lead) are prevented from scattering away during sintering. Consequently, staying degree of the sulfide (or lead) in the sintered alloy is enhanced to greatly improve the slidability.

In the sintered alloy, the sulfide is deposited in form of FeS, $Cr_2S$, MnS and the like, while lead is deposited in a form of Pb alone.

It is important in the present invention to control the particle sizes of sulfide (or lead) in the sintered alloy to less than 100 μm and dispersed uniformly in it. If the deposited particle size of the sulfide (or lead) are more than 100 μm, the sintered alloy is likely to become brittle so that the anti-wear property may be damaged.

The advantages of the present invention will be shown with reference to the test results on the examples and controls, but the present invention is, as a matter of course, not limited to these embodiments.

EXAMPLE 1

An atomized alloy powder comprising 2.5% of Cr, 0.1% of Mn, 0.1% of P, 1.0% of Cu, 0.5% of Si, 0.5% of S and the balance being Fe were prepared. After 1.6% of graphite was added to and mixed with the alloy powder, a compacted mold was prepared under compacting pressure of 6 ton/cm$^2$. The compacted mass thus obtained was sintered at 1180° C. in a reducing atomosphere for 60 min. to obtain a sintered alloy according to the present invention comprising of 2.5% of Cr, 0.1% of Mn, 0.1% of P, 1.0% of Cu, 0.5% of Si, 0.5% of S, 1.5% of C and the balance being Fe.

EXAMPLE 2

Similarly in Example 1, an atomized alloy powder comprising 5.0% of Cr, 1.0% of Mn, 0.5% of P, 2.0% of Cu, 1.0% of Si, 1.0% of Mo, 1.0% of S, and the balance being Fe was prepared. Then, 2.7% of graphite was added to and mixed with the alloy powder, and the compacting and sintering were carried out under the same conditions as in Example 1 except that the sintering temperature was 1110° C. Thus, a sintered alloy according to the present invention comprising 4.9% of Cr, 1.0% of Mn, 0.5% of P, 2.0% of Cu, 1.0% of Si, 1.0% of Mo, 1.0% of S, 2.5% of C, and the balance being Fe was obtained.

EXAMPLE 3

Similarly in Example 1, an atomized alloy powder comprising 25.0% of Cr, 3.0% of Mn, 0.8% of P, 5.0% of Cu, 2.0% of Si, 3.0% of Mo, 3.0% of S, and the balance being Fe was prepared. Then, 3.8% of graphite was added to and mixed with the atomized alloy powder. The compacting and sintering were carried out under the same conditions as in Example 1 except that the sintering temperature was 1100° C. Thus, a sintered alloy according to the present invention comprising 24.0% of Cr, 3.0% of Mn, 0.8% of P, 5.0% of Cu, 2.0% of Si, 3.0% of Mo, 2.8% of S, 3.5% of C, and the balance being Fe was obtained.

EXAMPLE 4

Similarly in Example 1, an atomized alloy powder comprising 2.5% of Cr, 0.1% of Mn, 0.1% of P, 1.0% of Cu, 0.5% of Si, 0.1% of Pb and the balance being Fe was prepared. Then, 1.6% of graphite was added to and mixed with the alloy powder. The compacting and sintering were carried out under the same conditions as in Example 1 except that the sintering temperature was 1180° C. Thus, a sintered alloy according to the present invention comprising 2.5% of Cr, 0.1% of Mn, 0.1% of P, 1.0% of Cu, 0.5% of Si, 0.9% of Pb, 1.5% of C and the balance being Fe was obtained.

EXAMPLE 5

Similarly in Example 1, an atomized alloy powder comprising 5.0% of Cr, 1.0% of Mn, 0.5% of P, 2.0% of Cu, 1.0% of Si, 1.0% of Mo, 3.0% of Pb, the balance being Fe was prepared. Then, 2.7% of graphite was added to and mixed with the alloy powder, and the compacting and sintering were carried out under the same conditions as in Example 1 except that the sintering temperature was 1120° C. Thus, a sintered alloy according to the present invention comprising 4.9% of Cr, 1.0% of Mn, 0.5% of P, 2.0% of Cu, 1.0% of Si, 1.0% of Mo, 1.0% of S, 2.5% of C, and the balance being Fe was obtained.

EXAMPLE 6

Similarly in Example 1, an atomized alloy powder comprising 25.0% of Cr, 3.0% of Mn, 0.8% of P, 5.0% of Cu, 2.0% of Si, 3.0% of Mo, 5.0% of Pb, the balance being Fe was prepared. Then, 3.8% of graphite was added to and mixed with the alloy powder, and the compacting and sintering were carried out under the same conditions as in Example 1 except that the sintering temperature was 1110° C. Thus, a sintered alloy according to the present invention comprising 24.0% of Cr, 3.0% of Mn, 0.8% of P, 5.0% of Cu, 2.0% of Si, 3.0% of Mo, 4.7% of Pb, 3.5% of C, and the balance being Fe was obtained.

CONTROL 1

Similarly in Example 1, an atomized alloy powder comprising 5.0% of Cr, 1.0% of Mn, 0.5% of P, 2.0% of Cu, 1.0% of Si, 1.0% of Mo, and the balance being Fe was prepared. After 2.7% of graphite was added to the alloy powder, the compacting and sintering were carried out under the same conditions as in Examples 2 or 5, thereby producing a sintered alloy comprising 4.9% of Cr, 1.0% of Mn, 0.5% of P, 2.0% of Cu, 1.0% of Si, 1.0% of Mo, 2.5% of C, and the balance being Fe (U.S. patent application Ser. No. 213,239).

CONTROL 2

After 1.3% of Sulfur powder and 2.7% of graphite were added to and mixed with the alloy powder obtained in Control 1, the compacting and sintering were carried out under the same conditions as in Example 2 to produce a sintered alloy comprising 4.9% of Cr, 1.0% of Mn, 0.5% of P, 2.0% of Cu, 1.0% of Si, 1.0% of Mo, 1.0% of S, 2.5% of C, and the balance being Fe.

CONTROL 3

After 4.0% of Pb power and 2.7% of graphite were added to and mixed with the alloy powder obtained in Control 1, the molding and sintering were carried out under the same conditions as in Example 5 to produce a sintered alloy comprising 4.9% of Cr, 1.0% of Mn, 0.5% of P, 2.0% of Cu, 1.0% of Si, 1.0% of Mo, 2.9% of Pb, 2.5% of C, and the balance being Fe.

TEST RESULTS

A cam for use in an internal combustion engine was manufactured using each of sintered alloys in Examples 1-6 and Controls 1-3. Durability test was conducted for 5 hours while each cam was coupled with a rocker arm of cast iron with high chrome content under no lubrication and 3000 rpm conditions, the initial fitting property being evaluated in Table 1.

TABLE 1

| | Characteristics of sintered alloy | | | | Anti-wear property | |
|---|---|---|---|---|---|---|
| | Density ratio of compacted mass* (%) | Hardness Hv (10 Kg) | Density ratio (%) | S or Pb Staying ratio (%) | Worn-out amount of cam (μm) | Worn-out amount of rocker arm (μm) |
| Example 1 | 79 | 550 | 97 | 95 | 95 | 70 |
| 2 | 78 | 530 | 96 | 95 | 60 | 60 |
| 3 | 78 | 500 | 95 | 93 | 80 | 50 |
| 4 | 78 | 540 | 97 | 94 | 75 | 60 |
| 5 | 78 | 520 | 96 | 93 | 35 | 40 |
| 6 | 77 | 500 | 94 | 94 | 60 | 40 |
| Control 1 | 79 | 550 | 97 | — | 120 | 90 |
| 2 | 74 | 420 | 90 | 77 | 350 | 160 |
| 3 | 73 | 380 | 88 | 73 | 330 | 150 |

*Density ratio of compacted mass:

The comparison of the test results between Examples 1-6 and Control 1 clearly shows the excellent effect imparted by the addition of S or Pb, i.e., remarkably high anti-wear property. Further, the effects imparted by atomizing S or Pb together with the other metal components to obtain the alloy powder having S or Pb are clear by the comparison of the test results between Example 2 and Control 2 and between Example 5 and Control 3. In case the separately prepared powder of sulfide or lead is mixed with the alloy powder it is seen from Table 1 that the density of the compacted powder mass was lowered; the staying degree of sulfide or lead in the sintered alloy dropped and the favourable characteristics of the sintered alloy was lost. The durability property dropped to a larger extent compared with Control 1.

As mentioned above, the sintered alloy according to the present invention is manufactured by preparing the alloy powder containing S or Pb, and adding carbon, and compacting the powder and sintering it. The sintered alloy according to the present invention exhibits more excellent anti-wear property and improves the fitting property to a piece to be coupled, thereby reducing the worn-out amount of the opponent member.

It is further understood by those skilled in the art that the foregoing description relates merely to the preferred examples of the present invention and that various changes and modifications thereof may be resorted to without departing from the spirit of the invention.

Having thus described the invention, what is claimed as new and as sought to be patented by Letters Patent of the United States is:

1. An anti-wear sintered alloy comprising from 2.5 to 25.0% of Cr, from 0.10 to 3.0% of Mn, from 0.1 to 0.8% of P, from 1.0 to 5.0% of Cu, from 0.5 to 2.0% of Si, from 0 to 3% of Mo, 1.5 to 3.5% of C, one selected from the group consisting of from 0.5 to 3.0% of S, and from 1.0 to 5.0% of Pb, and the balance being Fe with less than 2% of impurities, wherein S or Pb is distributed uniformly in the sintered alloy in form of sulfide or lead particles of less than 100 μm.

2. An anti-wear sintered alloy claimed in claim 1, comprising from 2.5 to 25.0% of Cr, from 0.10 to 1.5% of Mn, from 0.35 to 0.65% of P, from 1.0 to 3.0% of Cu, from 0.7 to 1.5 of Si, from 0.5 to 1.5% of Mo, one selected from the group consisting of from 0.5 to 2.0% of S, and from 1.0 to 3.0% of Pb, from 1.0 to 3.0% of C, and the balance being with less than 2% Fe of impurities.

3. An anti-wear sintered alloy claimed in claim 1 or 2, which is manufactured by adding C to powder of Cr, Mn, P, Cu, Si, Mo, and one selected from the group consisting of Si and Pb, followed by compacting and sintering.

4. A cam which is made of the anti-wear sintered alloy claimed in claim 1 or 2.

5. A cam which is made of the anti-wear sintered alloy claimed in claim 3.

6. A process for manufacturing an anti-wear sintered alloy, said process comprising: preparing an alloy powder comprising from 2.5 to 25.0% of Cr, from 0.10 to 3.0% of Mn, from 0.1 to 0.8% of p, from 1.0 to 5.0% of Cu, from 0.5 to 2.0% of Si, from 0 to 3.0% of Mo, one selected from the group consisting of from 0.5 to 2.0% of S, and from 1.5 to 5.0% of Pb, and the balance being Fe with less than 2% through atomization;

adding from 1.5 to 3.5% of carbon to the powder mixture;

compacting the mixture obtained in the just preceeding step into a predetermined shape; and sintering the resulting mold.

7. A process for manufacturing an anti-wear sintered alloy claimed in claim 6, wherein said mixture is compacted under a pressure of from 5 to 7 ton/cm$^2$ and the sintering is carried out at from 1050° to 1180° C. for from 45 to 90 minutes.

8. A process for manufacturing an anti-wear sintered alloy claimed in claim 6 or 7, wherein the sintering is carried out in a decomposed $NH_3$ gas of dew point less than −10° C.

* * * * *